US007261112B2

(12) United States Patent
Liu

(10) Patent No.: US 7,261,112 B2
(45) Date of Patent: Aug. 28, 2007

(54) FIRM AUTOMATIC MULTI-SECTIONAL COLLAPSIBLE UMBRELLA STRUCTURE

(75) Inventor: Fu-Tien Liu, P.O. Box No. 6-57, Junghe, Taipei 235 (TW)

(73) Assignees: Ping-Tung Su, Hsin-Chu (TW); Fu-Tien Liu, Lu-Chou (TW)

( * ) Notice: Subject to any disclaimer, the term of this patent is extended or adjusted under 35 U.S.C. 154(b) by 246 days.

(21) Appl. No.: 10/945,954

(22) Filed: Sep. 22, 2004

(65) Prior Publication Data

US 2006/0060234 A1 Mar. 23, 2006

(51) Int. Cl.
*A45B 25/08* (2006.01)
*S44B 19/04* (2006.01)

(52) U.S. Cl. ..... 135/28; 135/25.1; 135/39; 403/109.1; 403/379.2

(58) Field of Classification Search ..... 135/28, 135/37–41, 20.3, 25.1, 25.4; 403/109.1, 403/109.2, 109.3, 327–329, 378, 379.2
See application file for complete search history.

(56) References Cited

U.S. PATENT DOCUMENTS 3,658,076 A * 4/1972 Yasuda ..... 135/22
5,020,558 A * 6/1991 Huang ..... 135/24
5,178,174 A * 1/1993 Wu ..... 135/22
5,287,869 A * 2/1994 Wu ..... 135/25.1
5,387,048 A * 2/1995 Kuo ..... 403/109.3
5,564,449 A * 10/1996 Lin et al. ..... 135/24
5,632,290 A * 5/1997 Ling Kuo ..... 135/24
6,070,602 A * 6/2000 Ling Kuo ..... 135/25.4
6,382,222 B1 * 5/2002 Ko ..... 135/41
6,422,250 B1 * 7/2002 Wu et al. ..... 135/24
6,626,199 B2 * 9/2003 Lin et al. ..... 135/28
6,758,229 B2 * 7/2004 Wang ..... 135/41
6,769,441 B2 * 8/2004 Liu ..... 135/28
6,948,506 B2 * 9/2005 Wang ..... 135/28
7,089,950 B2 * 8/2006 Lin et al. ..... 135/38

* cited by examiner

*Primary Examiner*—Winnie Yip
(74) *Attorney, Agent, or Firm*—Alan Kamrath; Kamrath & Associates PA

(57) ABSTRACT

An umbrella includes a cover, a shaft with a multi-sectional structure, a notch, a runner, main ribs, stretchers, other coordinating multi-sectional ribs, or optionally, in addition, an auxiliary runner, a compression spring between the auxiliary runner and a plurality of stretching ribs. Around the notch is a plurality of pivotally disposed main ribs for supporting the cover, and around the runner is a plurality of pivotally disposed stretchers for supporting the main ribs. A locating tube is disposed below the notch which is pivotally connected to the main ribs. The locating tube has an upper end thereof fastened with the notch, and the auxiliary runner and the runner are accommodated around the locating tube, such that the runner is capable of firm up-and-down sliding movements on the locating tube, thereby steadily stretching the umbrella.

6 Claims, 9 Drawing Sheets

FIRM AUTOMATIC MULTI-SECTIONAL COLLAPSIBLE UMBRELLA STRUCTURE

BACKGROUND OF THE INVENTION (a) Field of the Invention

The invention relates to a firm automatic multi-sectional collapsible umbrella structure, and more particularly, to a multi-sectional automatic collapsible umbrella having a minimal volume when collapsed and enabling a shaft thereof to steadily stretch the umbrella for usage.

(b) Description of the Prior Art

Umbrellas are people's daily commodities for shielding against the sun and/or rain, with conveniences and practicability thereof being long favored. To offer better portability, a shaft of an umbrella is often devised as a multi-sectional design, so that an overall volume of the umbrella is reduced when collapsed and the umbrella can thus then be stored and carried in a more handy manner. To satisfy expanding market demands as well as to provide users with further conveniences, umbrella manufacturers later proposed an automatic multi-sectional collapsible umbrella as shown in FIG. 1.

Referring to FIG. 1, a current automatic multi-sectional collapsible umbrella 1 having automatic stretching capability comprises a cover 11, a multi-sectional shaft 12, a notch 13, an auxiliary runner 10, a runner 14, main ribs 15 and stretchers 16. Around the notch 13 is a plurality of pivotally disposed main ribs 15 for supporting the cover 11; around the auxiliary runner 10 is a plurality of pivotally disposed stretchers 16 for supporting the main ribs 15; and around the runner 14 is a plurality of pivotally disposed stretching ribs 18 for supporting the stretchers 16. The shaft 12 is in a multi-sectional form, and has an upper end thereof fixed to the notch 13. Within the multi-sectional tube of the shaft 12, and between the auxiliary runner 10 and the runner 14, are respectively provided with compression springs 32 and 31. When the umbrella 1 is collapsed, the shaft 12 is compressed and maintains as a shortened structure using a fastening device in a handle 19. Meanwhile, the compression spring 31 between the auxiliary runner 10 and the runner 14 is also set in a compressed state. When a trigger button at the handle 19 is triggered, the fastening device is instantaneously set free. The multi-sectional shaft 12 rapidly expands using elasticity of the compression spring 32 therein, and the auxiliary runner 10 and the runner 14 are instantaneously stretched using elasticity of the compression spring 31. Hence, through interlocking effects of the stretching ribs 18, the auxiliary runner 10 and the runner 14 are quickly sprung upwards to approach a place near and below the notch 13 to assist stretching the umbrella. To collapse the umbrella, the runner 14 is pulled downwards, and the umbrella can be entirely collapsed by overcoming elasticity of the compression springs 31 and 32.

Referring to FIG. 2 showing a elevational view, partially in section and with portions broken away of another multi-sectional collapsible umbrella capable of automatic stretching and collapsing movements, an umbrella 1A comprises a cover 11, a multi-sectional shaft 12, a notch 13, a runner 14, main ribs 15 and stretchers 16. Around the notch 13 is a plurality of pivotally disposed main ribs 15, and around the runner 14 is a plurality of pivotally disposed stretchers 16 for supporting the main ribs 15. The shaft 12 is a multi-sectional form, and has an upper end thereof fixed to the notch 13. The shaft 12 is further provided with a compression spring 31 therein, and between the runner 14 and the notch 13 is a connecting pull rope 4. The pull rope 4 has an outer end thereof connected to the runner 14, inserted through sliding wheels 131 and 132 at the notch 13, and a sliding wheel 133 at the runner 14; and the other end thereof inserted into the shaft 12, extended downward along the shaft 12, and connected to a fastening device at a handle 19. To stretch the umbrella, a button at the handle 19 is triggered to set free the fastening device, and the multi-sectional shaft 12 is then rapidly elongated using elasticity of the compression spring 31 therein. Meanwhile, a lower end of the pull rope 4 passes through the fastening device to be connected at the handle 19 while remaining immobile, such that the length of the pull rope 4 between the shaft 12 and the sliding wheel 131 at the runner 14 is gradually reduced, thereby lifting the runner 14 to approach a place near and below the notch 13 to complete stretching the umbrella. To collapse the umbrella, the button at the handle 19 is triggered, so as to first loosen the fastening device at the lower end of the pull rope 4. The pull rope 4 in the shaft 12 also becomes lax, and using a collapsing spring 161 for gathering the stretchers 16, the runner 14 is pushed to slide downward, thereby accomplishing automatic collapsing of the umbrella 1A.

According to the aforesaid descriptions, although the umbrellas 1 and 1A are capable of automatic stretching and collapsing movements the shaft 12, due to generally being two-sectional or multi-sectional designs, needs to be further devised into having more sections in order to provide the umbrella with a reduced overall volume. However, as the number of sections of the shaft 12 increases, it is inevitable that diameters of an innermost tube and an outermost tube thereof differ to a large extent. In addition, to prevent undesired wavering and deviations of the runner 14 and the auxiliary runner 10 when performing up-and-down movements at the shaft 12, the shaft 12 often has a section with a smallest outer diameter as it lower portion joined to the handle 19. Therefore, for that section of the shaft 12 with the smallest outer diameter, since its diameter is smaller than other section and thus relatively weaker in strength, bending and chipping are likely to result and thereby fail to steadily stretch the umbrella. Therefore, it is a vital task of umbrella manufacturers to provide an automatic multi-sectional collapsible umbrella, which has minimized overall volume and length and allows a shaft thereof to firmly support the umbrella to a stretched state when stretching the umbrella.

SUMMARY OF THE INVENTION

The primary object of the invention is to provide an automatic multi-sectional collapsible umbrella comprising a locating tube below a notch thereof, such that a runner thereof is capable of steady up-and-down movements along the locating tube, thereby firmly stretching the umbrella. Meanwhile, a multi-sectional tube of the umbrella can be completely stored in the locating tube to offer the umbrella with minimized volume and length.

The secondary object of the invention is to provide an automatic multi-sectional collapsible umbrella having an upper end of a section of multi-sectional shaft having the smallest outer diameter fastened with a notch of the umbrella; or, an upper end of a section of multi-sectional shaft having the smallest outer diameter further provided with a joining sliding stopper that is located in a locating tube. Using the aforesaid structure, through the locating tube coordinating with the notch, a runner of the umbrella is able to steadily perform up-and-down sliding movements on the locating tube, thereby firmly stretching the umbrella. Meanwhile, the multi-sectional shaft of the umbrella can be completely stored in the locating tube to provide minimized volume and length.

To accomplish the aforesaid objects, an umbrella according to the invention comprises a cover, a shaft, a notch, a runner, main ribs, stretchers, other coordinating multi-sectional ribs, or optionally, in addition, an auxiliary runner a compression spring between the auxiliary runner and a plurality of stretching ribs. Around the notch is a plurality of pivotally disposed main ribs for supporting the cover, and around the runner is a plurality of pivotally disposed stretchers for supporting the main ribs. The shaft is a multi-sectional structure having sections thereof that can be accommodated in one another, and has a compression spring therein. Below the notch which is pivotally connected to the main ribs is a locating tube. The locating tube has an upper end thereof fastened with the notch, and the auxiliary runner and the runner are accommodated around the locating tube.

DETAILED DESCRIPTION OF THE PREFERRED EMBODIMENTS

To better understand the objectives, characteristics and functions of the invention, detailed descriptions of a preferred embodiment is provided with the accompanying drawings below.

Figure 1:
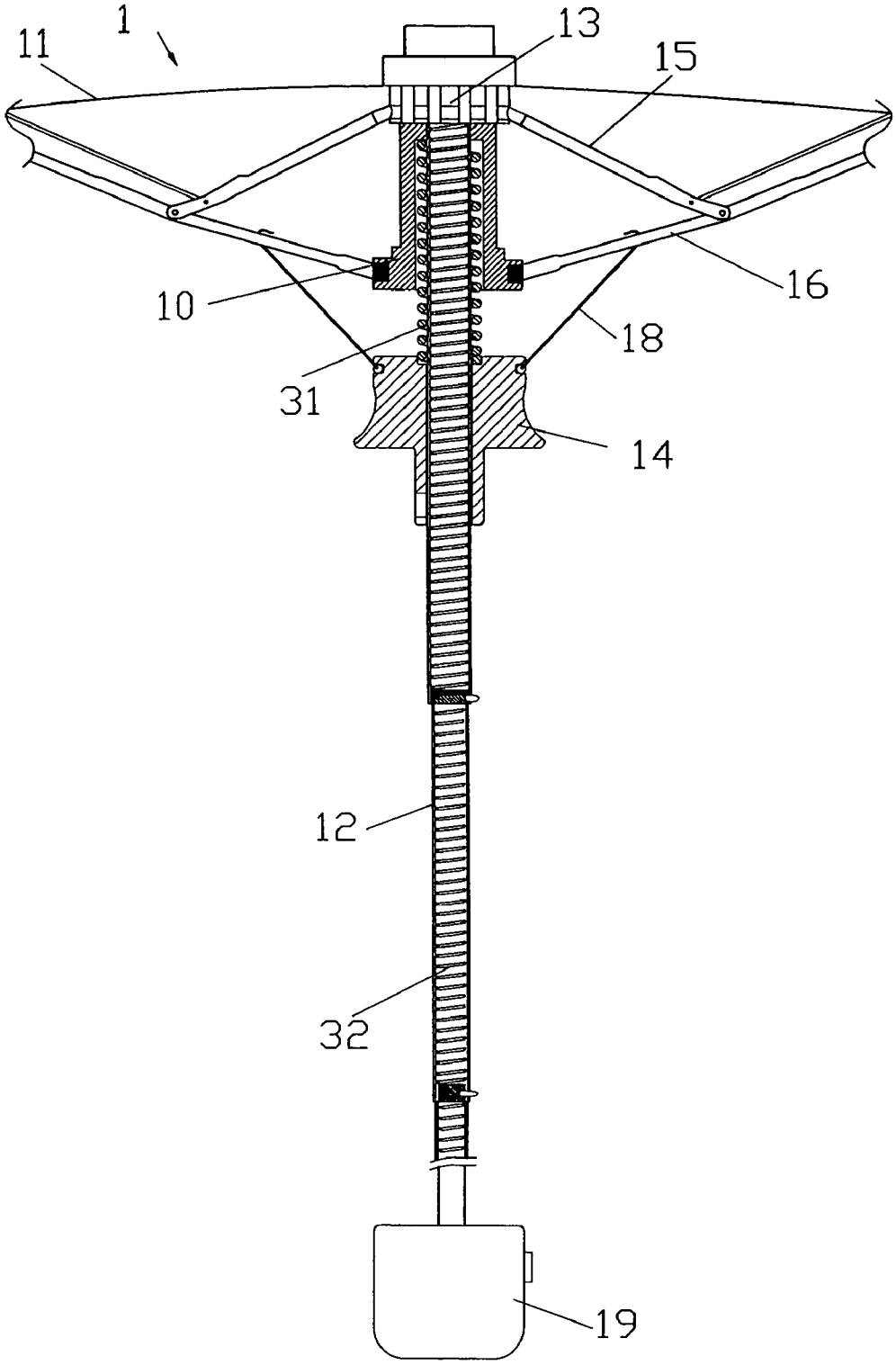
FIG.1 Prior Art
FIG. 1 shows a elevational view, partially in section, of a prior automatic multi-sectional collapsible umbrella, with portions broken away.
Figure 2:
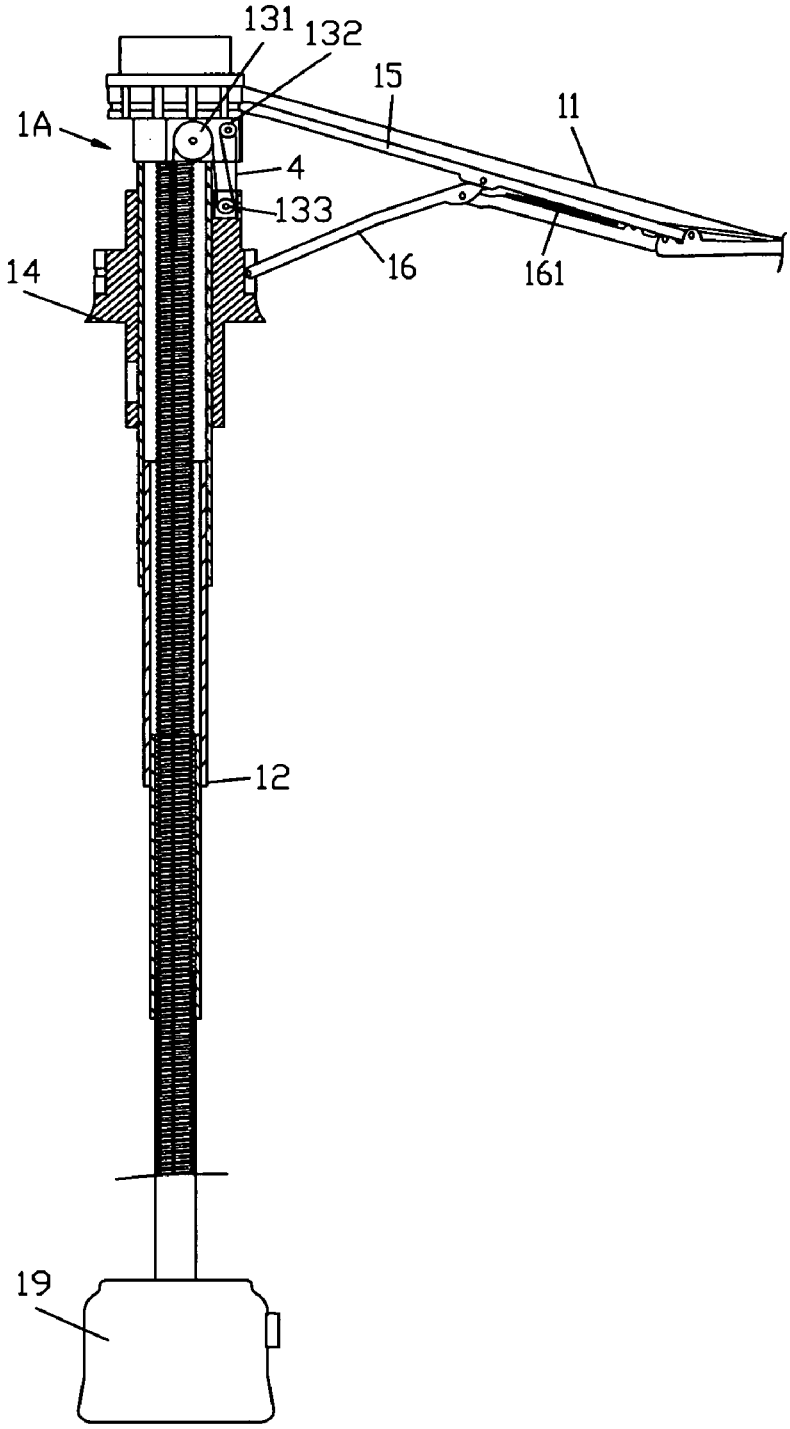
FIG.2 Prior Art
FIG. 2 shows a elevational view, partially in section, of another prior automatic multi-sectional collapsible umbrella, with portions broken away.
Figure 3:
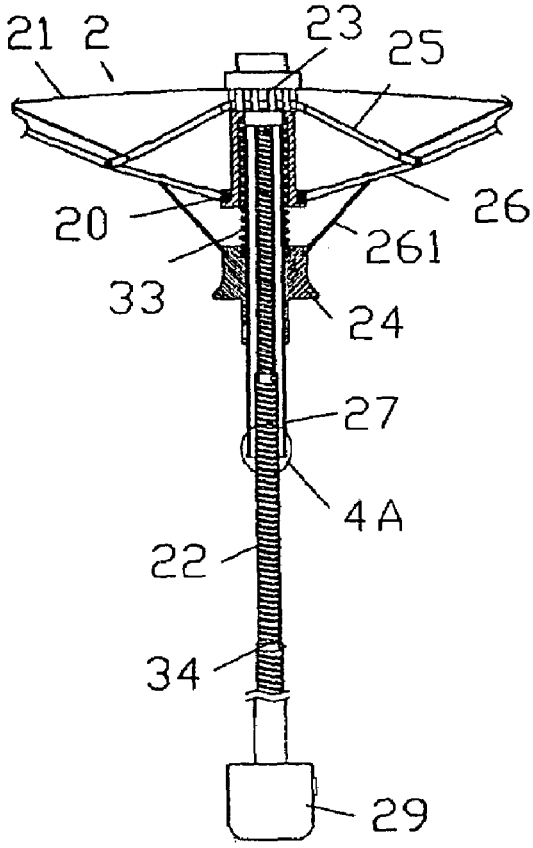
FIG. 3 shows a elevational view, partially in section of a first embodiment of the invention, with portions broken away.

FIG. 3 shows a elevational view, partially in section, of an embodiment of the invention, with portions broken away. The embodiment is a structure that is applied to a common automatic multi-sectional collapsible umbrella. An umbrella 2 comprises a cover 21, a multi-sectional shaft 22, a notch 23, an auxiliary runner 20, a runner 24, main ribs 25 and stretchers 26. Around the notch 23 is a plurality of pivotally disposed main ribs 25; around upper portion of the auxiliary runner 20 is a plurality of pivotally disposed stretchers 26 for supporting the main ribs 25; and around the runner 24 is a plurality of pivotally disposed stretching ribs 261 interconnecting the stretchers 26. The shaft 22 is in a multi-sectional form, and has a top end thereof fixed to the notch 23. Within the multi-sectional tube of the shaft 22, and between the auxiliary runner 20 and the runner 24, are respectively provided with compression springs 34 and 33. A section of the shaft 22 having the smallest outer diameter is accommodated with a locating tube 27, which has an opening with a diameter large enough for accommodating the section having the largest outer diameter of the shaft 22. The locating tube 27 has an upper end thereof fastened with the notch 23 that is pivotally connected to the main ribs 25. Meanwhile, the auxiliary runner 20 and the runner 24 are also correspondingly accommodated around the locating tube 27; that is, the auxiliary runner 20 and the runner 24 are capable of up-and-down sliding movements along the locating tube 27.

A sectional area of the locating tube 27 according to the aforesaid description can be devised in various shapes as being circular, rectangular, oval or polyhedral shapes.

Figure 4A:
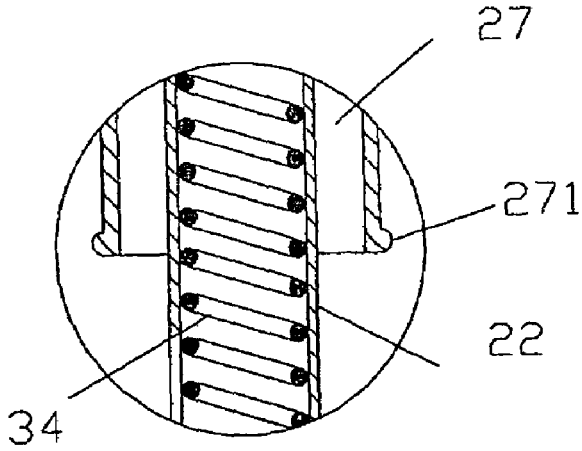
FIG. 4A shows an enlarged partial view of area 4A in FIG. 3.

Referring to FIG. 4A, a periphery at a lower end of the locating tube 27 is provided with a smooth, protruding rim 271. Using the protruding rim 271, a hand of a user is rather unlikely to be cut thereby providing better protection to the user.

Figure 6:
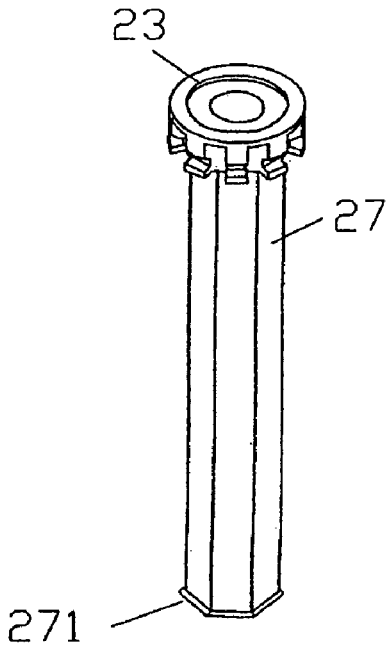
FIG. 6 shows a perspective view of a notch and a locating tube in another embodiment of the invention.
Figure 5:
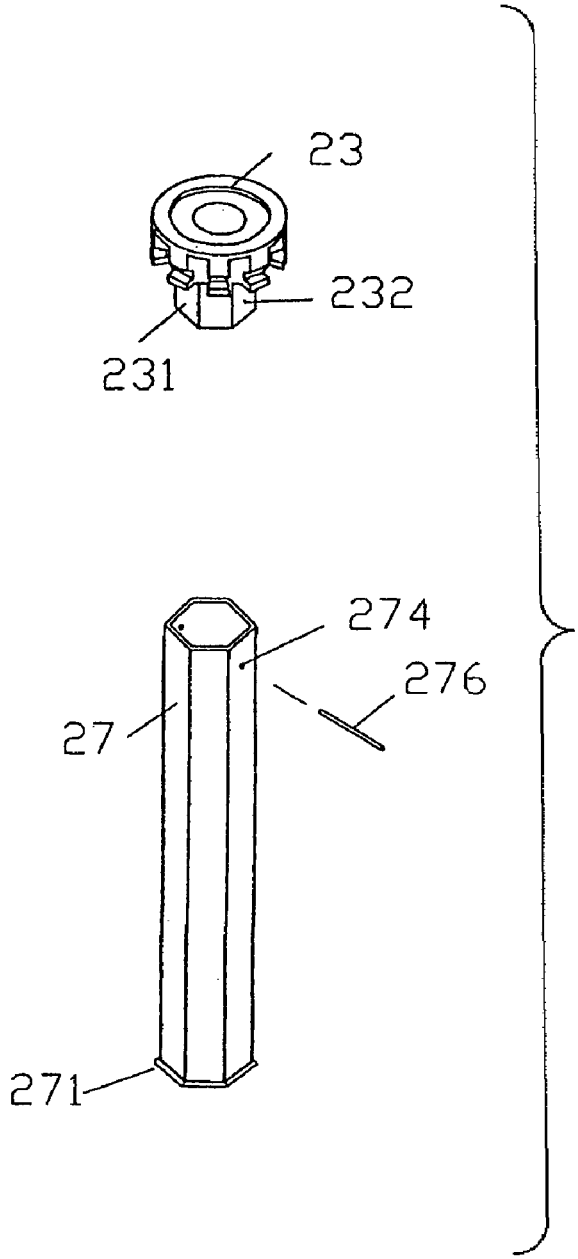
FIG. 5 shows an exploded perspective view of the assembly of a notch and a locating tube in FIG. 3.

In view of the aforesaid descriptions and referring to FIG. 5, the notch 23 and the locating tube 27 are integrally formed. FIG. 6 shows another implementation of the embodiment, a distinction between this implementation and that shown in FIG. 5 is that, the locating tube 27 and the notch 23 of the previous implementation are integrally formed, whereas the locating tube 27 and the notch 23 in this implementation are separate members. The notch 23 is devised with a joining section 231 in a downward direction, with the joining section 231 provided with a joining opening 232. The locating tube 27 is provided with an insertion opening 274 corresponding to the joining opening 232, such that a pin 276 is inserted therein to connect the notch 23 with the locating tube 27. In this embodiment, when the umbrella 2 is in a collapsed state, the shaft 22 is contracted, through the fastening device within the handle 29 the umbrella 2 remains in a collapsed state, and the compression spring 33 between the auxiliary runner 20 and the runner 24 is in a compressed state. When the button at the handle 29 is triggered, the fastening device is set free, and the multi-sectional shaft 22 is quickly elongated using elasticity of the compression spring 33 in the shaft. Meanwhile, the runner 24 approaches the auxiliary runner 20 through actions of the compression spring 33, thereby stretching the umbrella 2. To collapse the umbrella, elasticity of the compression springs 33 and 34 are overpowered by external forces to completely collapse the umbrella 2.

Figure 7:
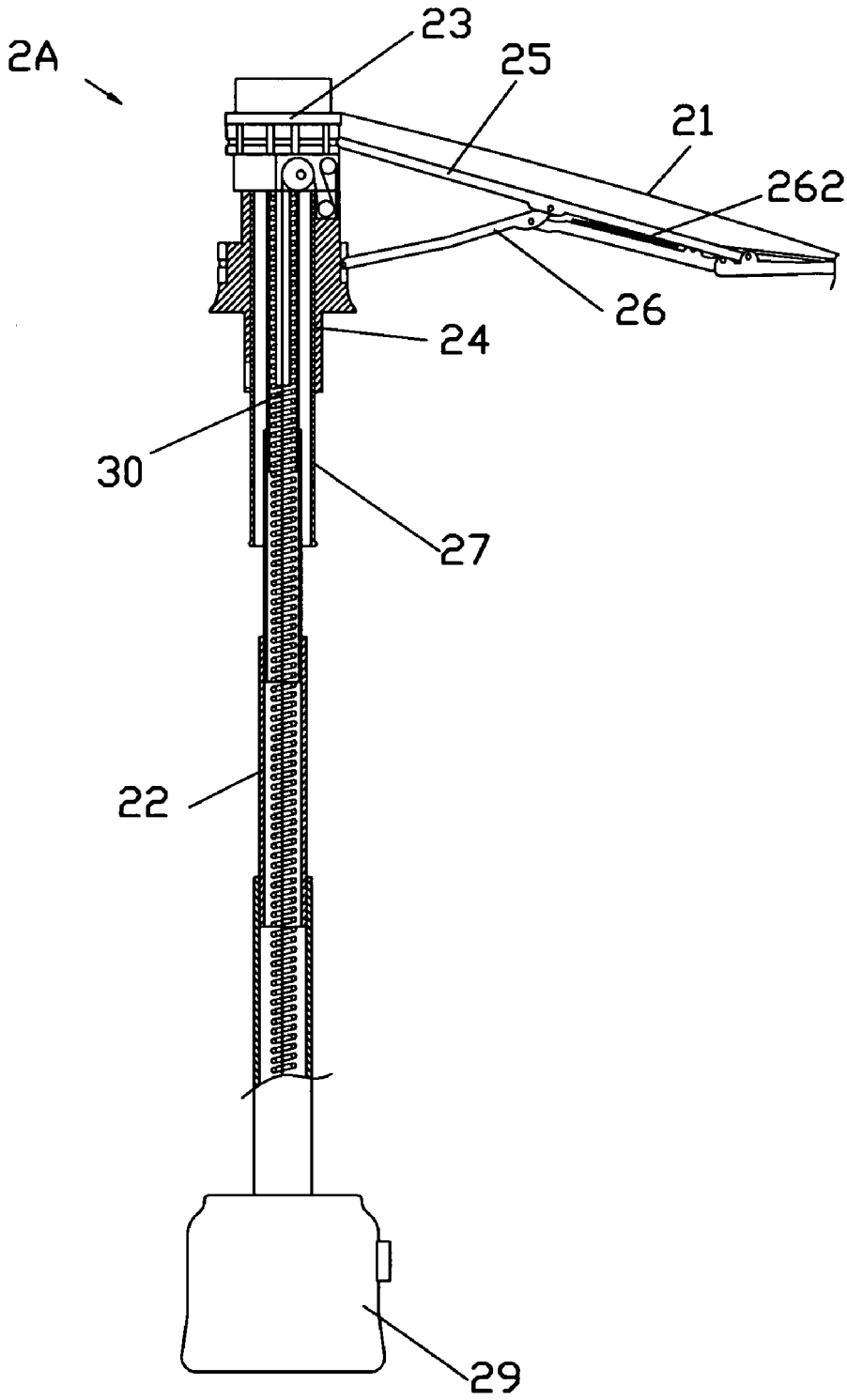
FIG. 7 shows a elevational view, partially in section, of a second embodiment of the invention, with portions broken away.

Referring to FIG. 7, the invention may also apply to a pull-rope style automatic collapsible umbrella 2A. Similarly, a section of the shaft 22 having the smallest outer diameter is accommodated with a locating tube 27, which has an upper end thereof fastened to or integrally formed with the notch 23 which is pivotally connected to the main ribs 25. In addition, the runner 24 is accommodated around the locating tube 27; that is, the runner 24 is capable of up-and-down sliding movements along the locating tube 27.

To stretch the umbrella, a button at the handle 29 is triggered to set free the fastening device, and the multi-sectional shaft 22 is then rapidly elongated using elasticity of the compression spring 30 therein. Meanwhile, a lower end of a pull rope 4 passes through the fastening device to be connected at the handle 29 while remaining unmoved, such that the length of the pull rope 4 between the shaft 22 and a sliding wheel at the runner 24 is gradually reduced, thereby lifting the runner 24 to approach a place near and below the notch 23 to completely stretch the umbrella. To collapse the umbrella, the button at the handle 29 is triggered to disengage and set free the fastening device that is at the lower end of the pull rope 4. The pull rope 4 in the shaft 22 also becomes lax, and the supporting effects that the runner 24 applies to the stretchers 26 extinguishes. Thus, the stretchers 26 are pulled by forces of a collapsing spring 262 to push the runner 24 that further slides downward, thereby accomplishing automatic collapsing of the umbrella 2A.

Figure 8:
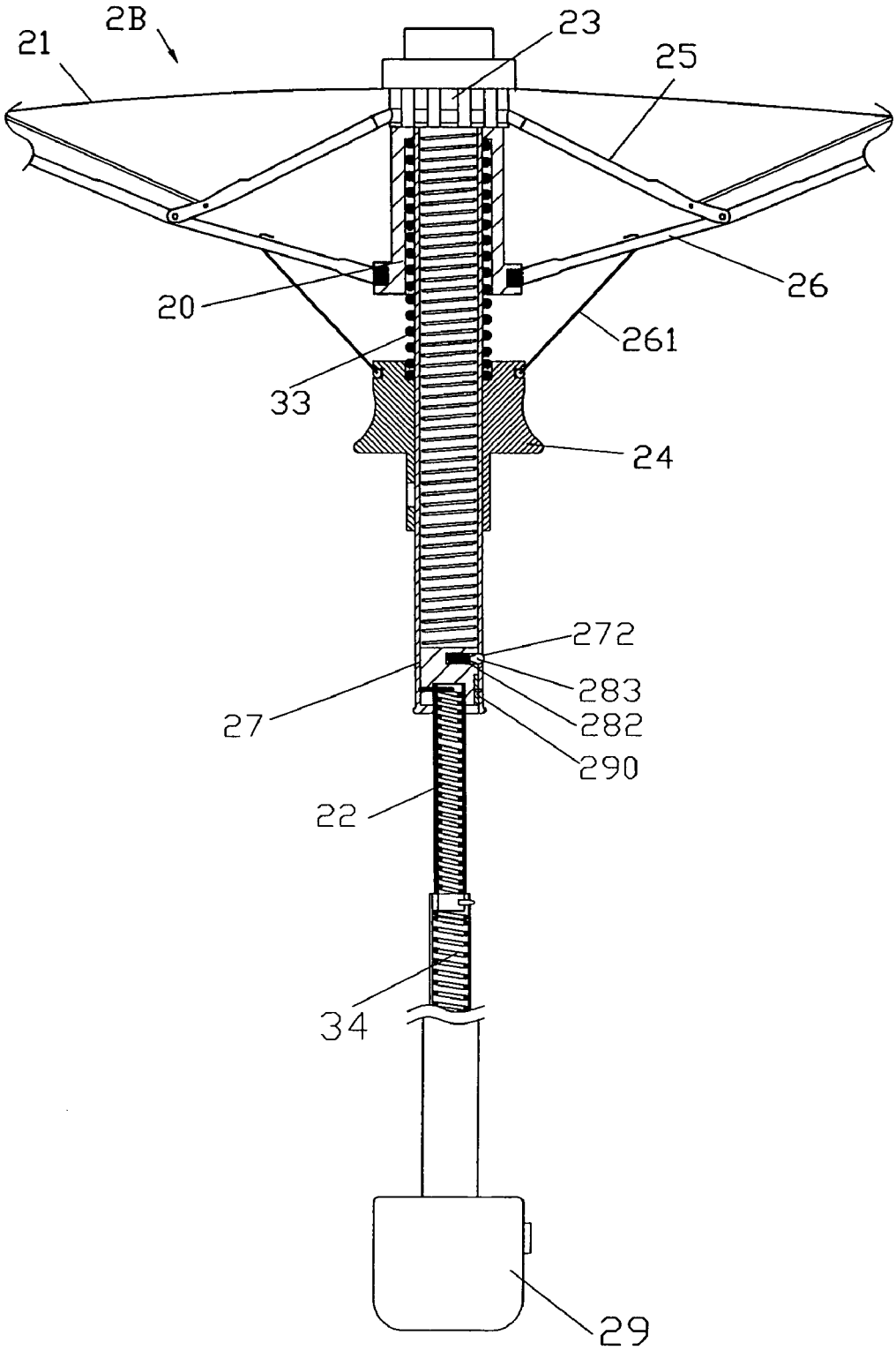
FIG. 8 shows a elevational view, partially in section, of a third embodiment of the invention, with portions broken away.

Referring to FIG. 8 showing a third embodiment of the invention, a structure in this embodiment is similar to that of the first embodiment as a common automatic umbrella, with a difference being that an upper end of a section of the shaft 22 having the smallest outer diameter not being directly fastened to a notch 23. According to the structure of this embodiment, an umbrella 2B also comprises a cover 21, a multi-sectional shaft 22, a notch 23, an auxiliary runner 20, a runner 24, main ribs 25 and stretchers 26. Around the notch 23 is a plurality of pivotally disposed main ribs 25; around the auxiliary runner 20 is a plurality of pivotally disposed stretchers 26 for supporting the main ribs 25; and around the runner 24 is a plurality of pivotally disposed stretching ribs 261. Within the multi-sectional tube of the shaft 22, and between the auxiliary runner 20 and the runner 24, are respectively provided with compression springs 34 and 33. A section of the shaft 22 having the smallest outer diameter is accommodated with a locating tube 27, which has an opening with a diameter large enough for accommodating the section of the shaft 22 having the largest outer diameter. The locating tube 27 has an upper end thereof fastened to or integrally formed with the notch 23 which is pivotally connected to the main ribs 25. Meanwhile, the auxiliary runner 20 and the runner 24 are also correspondingly accommodated around the locating tube 27; that is, the auxiliary runner 20 and the runner 24 are capable of up-and-down sliding movements along the locating tube 27. An upper end of a section of the shaft 22 having the smallest outer diameter is provided with a joining sliding stopper 28 that is also disposed in the locating tube 27, such that the joining sliding stopper 28 is capable of up-and-down sliding movements within the locating tube 27.

Figure 9:
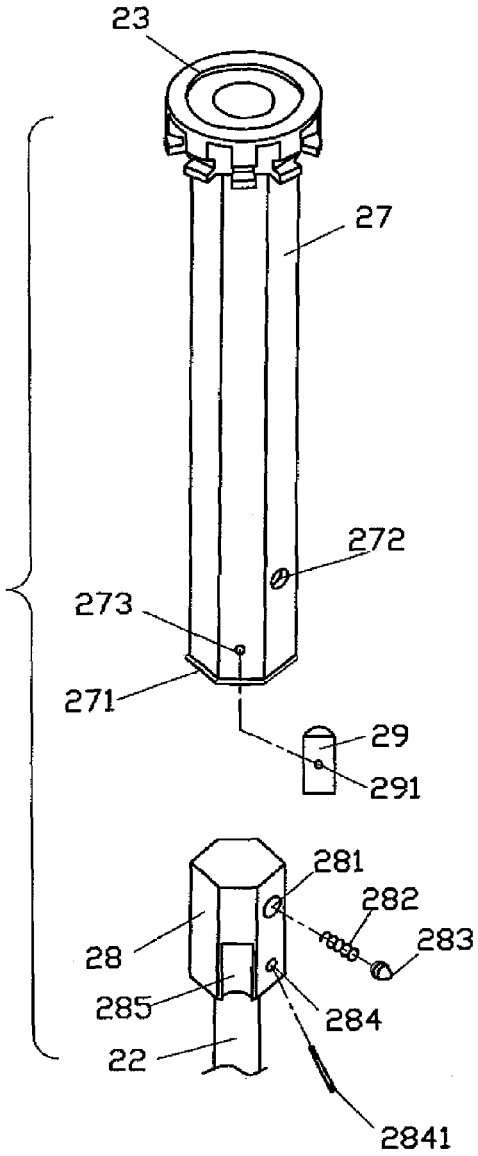
FIG. 9 shows an exploded perspective view of the assembly of a notch and a locating tube in FIG. 8, with portions broken away.
Figure 10:
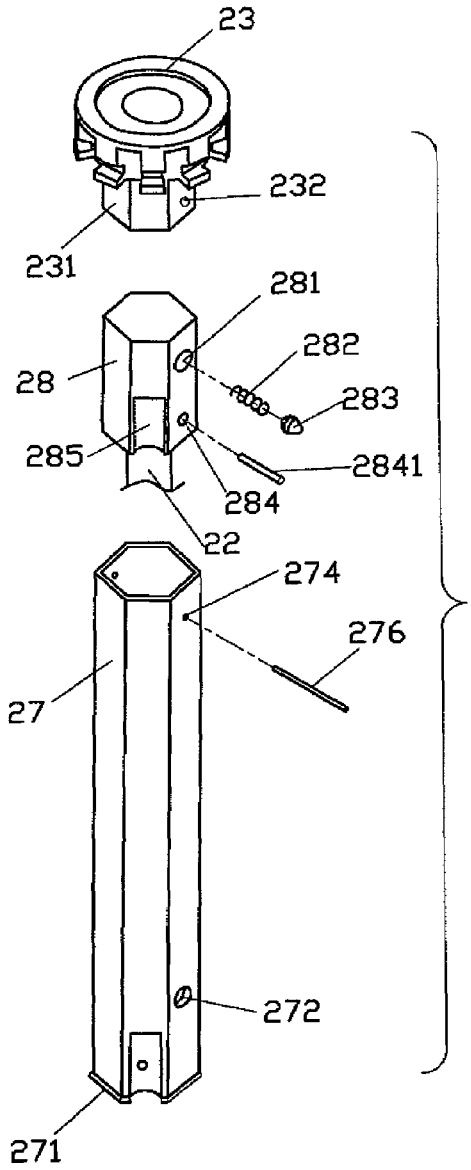
FIG. 10 shows an exploded perspective view of a notch and a locating tube in another embodiment of the invention with portions broken away.

Referring to FIGS. 9 and 10, a connecting mechanism between the notch 23 and the locating tube 27 in this embodiment is the same as that described in the first embodiment, and comprises integrally formed notch 23 and locating tube 27, or notch 23 and locating tube 27 being two separate members. In this embodiment, the joining sliding stopper 28 utilizes a locating pin element 2841 to join with the shaft 22. That is, that the joining sliding stopper 28 is disposed at an appropriate place at the upper end of a section of shaft 22 having the smallest outer diameter with a joining opening 284 further disposed on the joining sliding stopper 28, and the locating pin element 2841 is inserted through the upper end of a section of shaft 22 having the smallest outer diameter and through the joining opening 284, so as to join the sliding joining stopper 28 with the upper end of a section of shaft 22 having the smallest outer diameter. The joining sliding stopper 28 has a fastening bead opening 281 and a dented fastening section 285. The fastening bead opening 281 accommodates a spring 282 and a fastening bead 283. The locating tube 27 is provided with a fastening opening 272 and a fastening plate 290 corresponding with the fastening bead 283 and the dented fastening section 285, wherein the fastening opening 272 may be disposed at any appropriate position on the locating tube 27 as required: When the shaft 22 is extended, the fastening plate 290 on the locating tube 27 is fastened and positioned with the dented fastening section 285 at the joining sliding stopper 28, and the fastening bead 283 shoots out through the fastening opening 272 on the locating tube 27 to provide locating effects, thereby steadily joining the joining sliding stopper 28 and the locating tube 27. In addition, the fastening plate 290 has one side thereof provided with a locating column 291, and the locating tube 27 is provided with a locating opening 273 for corresponding with the locating column 291, thereby firmly fastening or attaching the fastening plate 290 in a lower portion of the locating tube 27.

In this embodiment, the locating tube 27 accommodates the joining sliding stopper 28 therein, and the locating tube 27 becomes an extended length to the multi-sectional shaft 22 when the umbrella 2B is stretched. When the umbrella 2B is collapsed, the multi-sectional 22 is entirely stored in the locating tube 27 that is below the notch 23, thereby minimizing volume and length of the umbrella 2B.

Figure 11:
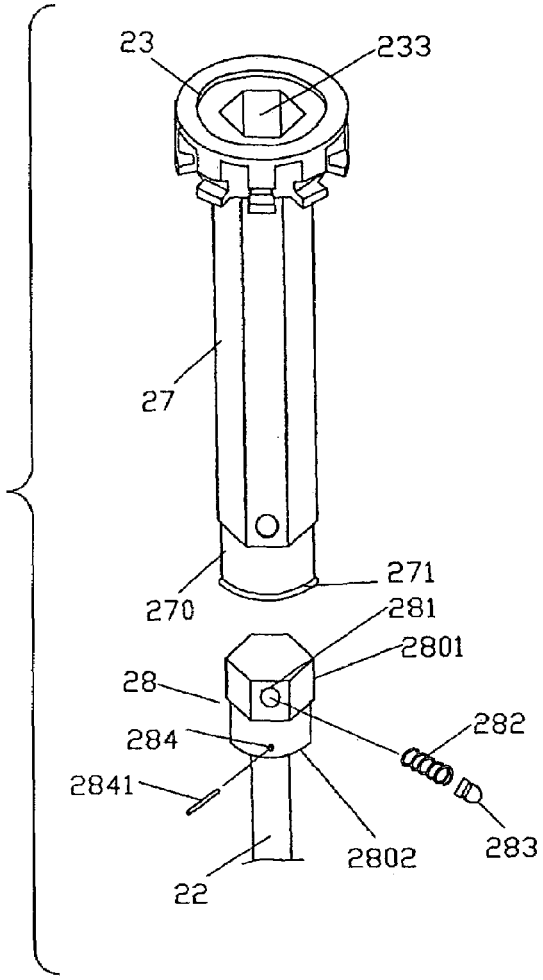
FIG. 11 shows an exploded perspective view of another embodiment of FIG. 8, with portions broken away.

The joining sliding stopper 28 and the locating tube 27 in the above-described embodiment can also be devised in other structures. Referring to FIG. 11 that shows another embodiment of the invention, the joining sliding stopper 28 has an upper portion 2801 thereof devised as a hexagonal structure for corresponding with a sectional area of the locating tube 27, and a lower portion 2802 thereof provided as a hexagonal column placed in the upper portion 2801. The upper portion 2801 has a fastening bead opening 281 accommodating a spring 282 and a fastening bead 283. The locating tube 27 is provided with a fastening opening 272 corresponding with the fastening bead 283, and a lower end of the locating tube 27 is devised with a binding tube 270 for corresponding with the lower portion 2802 of the joining sliding stopper 28. A lower edge of the binding tube 270 devised with a smooth protruding rim 271. Furthermore, referring to FIG. 10, the joining sliding stopper 28 can be joined with an upper end of a section of shaft 22 having the smallest outer diameter using a locating pin element 2841. When the shaft 22 is extended, the joining sliding stopper 28 slips downward to the lower end of the locating tube 27 using pulling forces of the shaft 22. At this point, the lower portion 2802 of the joining sliding stopper 28 drops into the binding tube 270 of the locating tube 27, and the fastening bead 283 at the upper portion 2801 shoots out via the fastening opening 272 at the locating tube 27 to provide positioning effects, thereby firmly joining the joining sliding stopper 28 and the locating tube 27. During the assembly process, it is necessary that the notch 23 is further devised with a through hole 233 that connects with the locating tube 27, such that the joining sliding stopper 28 first drops through the through hole 233, into the locating tube 27 and then joins with an upper end of the shaft 22.

Figure 12:
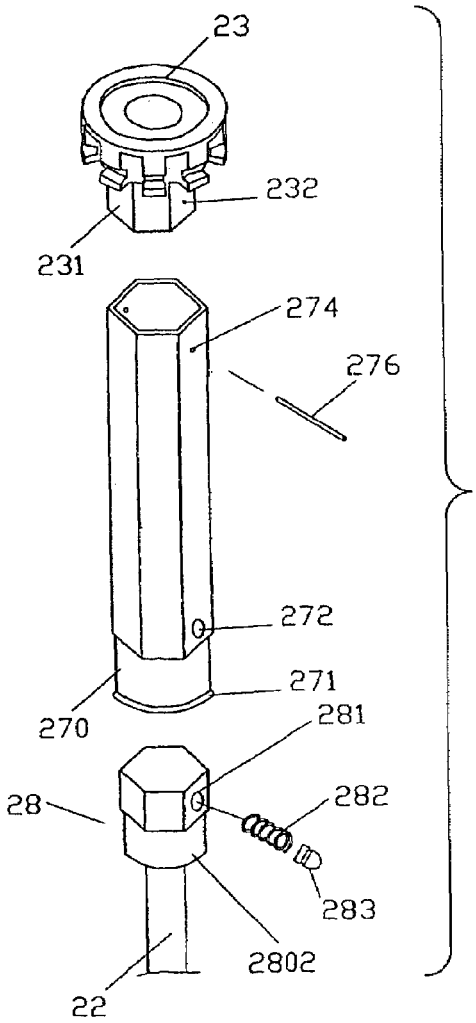
FIG. 12 shows an exploded perspective view of another embodiment of FIG. 11, with portions broken away.

Referring to FIG. 11, in this embodiment, the upper end of the locating tube 27 and the notch 23 that is pivotally connected with the main ribs 25 can be integrally formed, or fastened to each other as in the aforesaid descriptions and shown in FIG. 12. Referring to FIG. 12, where the upper end of the locating tube 27 is fastened to the notch 23, during the assembly process, it requires that the joining sliding stopper 28 be first slid into the locating tube 27 via an opening at the upper end of the locating tube 27, followed by fastening the notch 23 with the locating tube 27.

Figure 13:
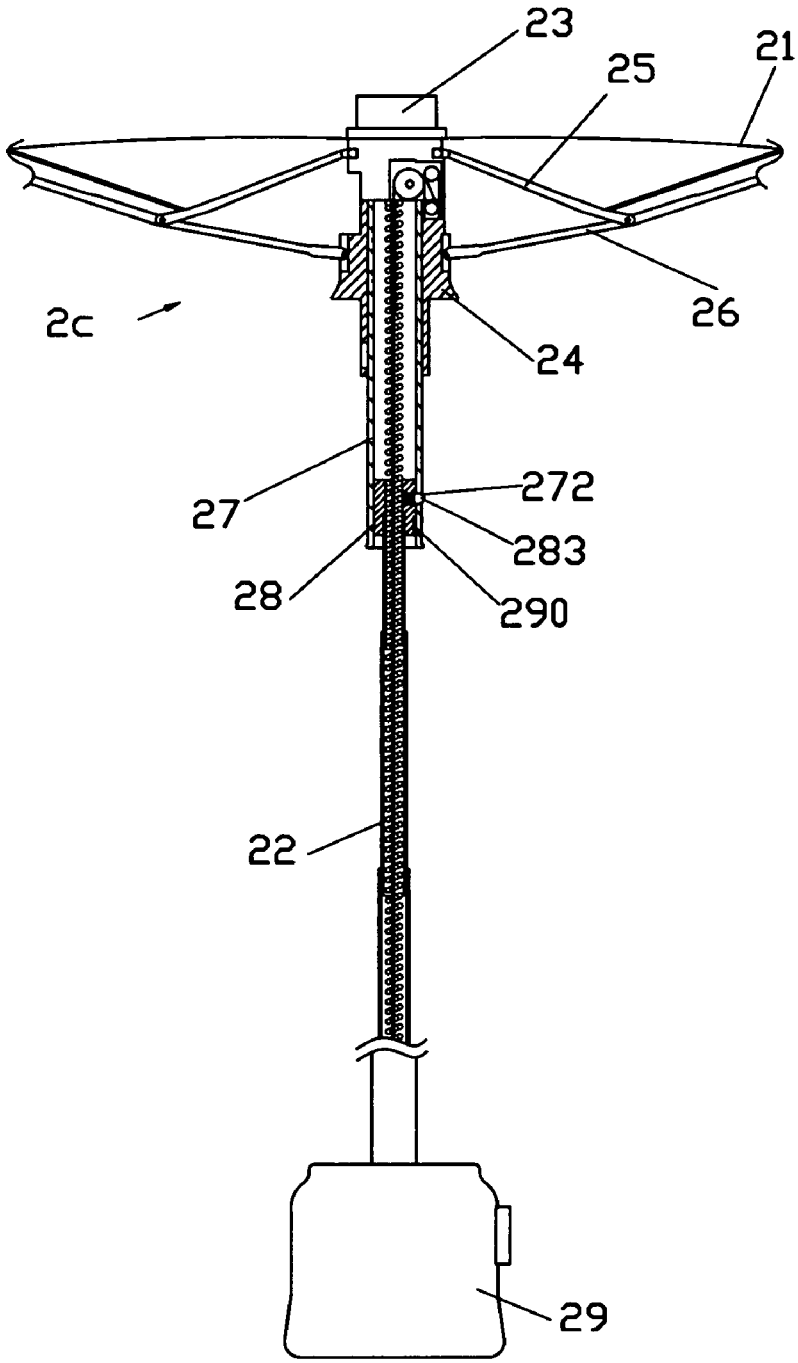
FIG. 13 shows a elevational view, partially in section, of a fourth embodiment according to the invention, with portions broken away.

FIG. 13 shows a fourth embodiment of the invention which is a pull-rope automatic collapsible umbrella 2C with similar structure comprising a joining sliding stopper 28 in the locating tube 27, and an upper end of the shaft 22 fastened with the joining sliding stopper 28. The structure of this embodiment is a combination of the aforesaid second and third embodiments, and will not be unnecessarily repeated hereunder.

In view of the above, using the structure of this invention, the runner 24 and the auxiliary runner 20 of an automatic multi-sectional collapsible umbrella are able to steadily slide on the locating tube 27 thereby firmly stretching the shaft 22 without producing undesired wavering. Moreover, in this invention, a section of the shaft 22 having the largest outer diameter is situated at the lower end of the shaft 22 and is fastened and located with the handle 29, the umbrella is provided with greater strength for preventing the shaft from bending and for prolonging the lifespan of the umbrella. Meanwhile, when the umbrella is collapsed, the multi-sectional shaft 22 is entirely stored in the locating tube 27 that is below the notch 23, thereby minimizing overall volume and length of the fully collapsed umbrella. The present invention indeed offers enhanced practicability and economical values compared to those of prior inventions.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. An automatic multi-sectional collapsible umbrella comprising:

a cover;

a shaft having a plurality of telescoping sections;

a notch;

a runner;

an auxiliary runner;

a locating tube having a first end connected to the notch, the shaft having an end inserted into an interior of the locating tube through a second end of the locating tube, wherein the end of the shaft inserted into the interior of the locating tube has a smallest outer diameter of the shaft and is connected to the notch;

a plurality of main ribs spaced around the notch and supporting the cover, each of the plurality of main ribs has one end pivotally connected to the notch;

a plurality of main stretchers supporting the plurality of mail ribs, each of the plurality of stretchers has one end pivotally connected to the auxiliary runner;

a plurality of stretching ribs pivotally connected to between the runner and the plurality of stretchers;

a first compression spring is located on an exterior of the locating tube between the runner and the auxiliary runner; and a second compression spring located in the shaft wherein the runner and auxiliary runner are located around the locating tube.

2. The automatic multi-sectional collapsible umbrella according to claim 1, wherein the notch and the locating tube are integrally formed.

3. The automatic multi-sectional collapsible umbrella according to claim 1, wherein the locating tube has a cross section selected from a group consisting of a circle, a rectangle, an oval and a polyhedral.

4. The automatic multi-sectional collapsible umbrella according to claim 1, wherein the second end of the locating tube has a protruding arm.

5. An automatic multi-sectional collapsible umbrella comprising:

a cover;

a shaft having a plurality of telescoping sections;

a notch;

a runner;

an auxiliary runner;

a locating tube having a first end connected to the notch, the shaft having an end inserted into an interior of the locating tube through a second end of the locating tube;

a joining sliding stopper, wherein the joining sliding stopper has an upper portion and a lower portion, the upper portion has a shape corresponding to a shape of a cross section of the interior of the locating tube, the lower portion is a polyhedral column, the upper portion has a fastening bead opening, a fastening bead and a fastening spring pressing the fastening bead into the fastening bead opening, the locating tube has a fastening opening and a binding tube located on the second end thereof, wherein, when the shaft is located in an extended position, the fastening bead protruding into the fastening opening of the locating tube securing the locating tube and the joining sliding stopper together;

a plurality of main ribs spaced around the notch and supporting the cover, each of the plurality of main ribs has one end pivotally connected to the notch;

a plurality of main stretchers supporting the plurality of mail ribs, each of the plurality of stretchers has one end pivotally connected to the auxiliary runner;

a plurality of stretching ribs pivotally connected to between the runner and the plurality of stretchers;

a first compression spring is located on an exterior of the locating tube between the runner and the auxiliary runner; and a second compression spring located in the shaft wherein the runner and auxiliary runner are located around the locating tube.

6. The automatic multi-sectional collapsible umbrella according to claim 5, wherein a lower end of the binding tube of the locating tube has a protruding rim.

* * * * *